US006725593B1

(12) United States Patent
Harris

(10) Patent No.: US 6,725,593 B1
(45) Date of Patent: Apr. 27, 2004

(54) KNIFE/BAYONET DEVICE INCLUDING RAPID ATTACHMENT, SHOOT THROUGH BAYONET UNIT

(76) Inventor: Wayne V. Harris, 3208 14th Ave., Phenix City, AL (US) 36869

( * ) Notice: Subject to any disclaimer, the term of this patent is extended or adjusted under 35 U.S.C. 154(b) by 0 days.

(21) Appl. No.: 10/277,937

(22) Filed: Oct. 23, 2002

(51) Int. Cl.[7] ..... F41C 27/00; F41C 27/18
(52) U.S. Cl. ..... 42/86
(58) Field of Search ..... 42/86

(56) References Cited

U.S. PATENT DOCUMENTS

| | | | | | |
|---|---|---|---|---|---|
| 54,728 | A | * | 5/1866 | Howard | 42/86 |
| 143,495 | A | * | 10/1873 | Burton | 30/296.1 |
| 152,320 | A | * | 6/1874 | Beals | 42/86 |
| 212,244 | A | * | 2/1879 | Lyford | 42/86 |
| 398,130 | A | * | 2/1889 | Cooper et al. | 42/24 |
| 2,823,481 | A | * | 2/1958 | Walter | 42/93 |
| 3,613,283 | A | * | 10/1971 | Mozey, Jr. | 42/86 |
| 4,813,333 | A | * | 3/1989 | Garris et al. | 89/14.3 |
| 4,821,356 | A | * | 4/1989 | Finn | 7/134 |
| 6,050,158 | A | * | 4/2000 | Cassutti et al. | 81/490 |

FOREIGN PATENT DOCUMENTS

| | | | | |
|---|---|---|---|---|
| DE | 3225722 A1 | * | 1/1984 | F41C/27/02 |
| GB | 2153283 A | * | 8/1985 | B26B/3/06 |

* cited by examiner

*Primary Examiner*—Charles T. Jordan
*Assistant Examiner*—John W. Zerr
(74) *Attorney, Agent, or Firm*—Stites & Harbison, PLLC; Ross F. Hunt, Jr.

(57) ABSTRACT

A knife/bayonet device is provided which is useful as both a knife and as a bayonet adapted to be mounted on a barrel portion, e.g., muzzle brake, of a rifle having a groove therein. The device includes an integral knife/bayonet component including a hollow handle portion and a blade. The handle portion is adapted to fit onto the barrel portion of the rifle and includes a locking groove having an opening therein extending through the handle portion. A locking ring received in the locking groove includes a detent portion adapted to extend through the opening in the locking groove to engage in the groove in the barrel portion of the rifle and thereby secure the knife/bayonet component to the rifle. A multi-purpose butt cap is adapted to be received in one end of the handle portion, and a storage canister is adapted to be affixed to the butt cap.

19 Claims, 6 Drawing Sheets

KNIFE/BAYONET DEVICE INCLUDING RAPID ATTACHMENT, SHOOT THROUGH BAYONET UNIT

FIELD OF THE INVENTION

This application relates to a knife/bayonet adapted to be removably mounted on a rifle and, in particular, to a knife/bayonet device including, inter alia, an improved mechanism for releasably attaching and locking the device on a rifle.

BACKGROUND OF THE INVENTION

For many years, rifles used in combat have been equipped with a bayonet mounted to the distal end of the rifle barrel. A bayonet typically has three major components: (i) the hilt, (ii) the crossguard, and (iii) the blade. Traditionally, with modern automatic rifles, a bayonet is mounted to the muzzle brake of the rifle using a muzzle ring. The muzzle ring is offset with respect to the hilt and blade of the bayonet and this can cause undesirable torque on the muzzle brake as the blade is forced at or into its target. Alternatively, mounting of a bayonet is effected using a bayonet stud located on the distal end of the rifle barrel, and this stud is used in combination with a particularly shaped ("bayonet-shaped") slot in the portion of the bayonet that slides over the distal end of the rifle barrel. A bayonet can also be used as a knife in close-in combat but to be effective, the bayonet must be quickly and easily removable from the rifle and easy to handle as a knife.

SUMMARY OF THE INVENTION

In accordance with the invention, a combination bayonet/knife device is provided which, in addition to its function as bayonet, can readily be used as a separate knife in hand-to-hand combat, and which incorporates additional features which enhance its usefulness in the field. The invention is particularly constructed for use with automatic rifles, such as the M4 and M16, and, in this regard, the bayonet unit of the device of the invention can be quickly and securely attached to the muzzle brake of such rifles, and also readily removed therefrom for use as a knife. The device of the invention is relatively inexpensive to manufacture while at the same time provides additional functionalities for field operations not provided by prior art bayonets.

In accordance with one aspect of the invention, there is provided a knife/bayonet device useful as both a knife and a bayonet adapted to be mounted on a barrel portion of a rifle having a groove therein, the device comprising: an integral knife/bayonet component including a hollow handle portion and a blade, said handle portion being adapted to fit onto the barrel portion of the rifle and including a locking groove having an opening therein extending through the handle portion; and a locking ring received in the locking groove so as to be rotatable in that groove, the locking ring including a detent portion adapted to extend through said opening and engage in the groove in the barrel portion of the rifle to thereby secure the knife/bayonet component to the rifle, said locking ring being rotatable between a first, locking position wherein said detent portion of the locking ring is seated in said opening and engages the groove in the barrel portion, and a second, release position wherein the detent portion of the locking ring is unseated from said opening so as to disengage the detent portion from the groove and thus enable removal of said knife/bayonet component.

Although the invention is not limited to such an application, in a preferred embodiment, the barrel portion of the rifle comprises a muzzle brake affixed to the barrel of the rifle, and the groove in the barrel portion comprises a standard circumferential groove in the muzzle brake.

Advantageously, the handle portion of the knife/bayonet component includes a plurality of holes therein. Preferably, at least some of said holes in said handle are aligned with exhaust holes in the muzzle brake.

Advantageously, the locking ring includes a knurled outer surface. Preferably, the locking ring includes a gap therein permitting opening of the ring to enable fitting thereof in the locking groove of the handle portion of the device.

In an important preferred embodiment, the device further comprises a butt cap adapted to be received in the proximal end of the handle portion. Preferably, the device further comprises a canister adapted to be connected to the butt cap. Advantageously, the butt cap includes a transverse hole therethrough. The transverse hole preferably includes a turning tool socket at at least one end thereof for receiving a turning tool stored in the canister. Preferably, the butt cap includes a first threaded portion for enabling the butt cap to be screwed into the proximal end of said handle portion and a second threaded portion for enabling the butt cap to be screwed into the canister. Advantageously, a portion of said butt cap including the through hole has a knurled outer surface. Preferably, the butt cap includes a first end adapted to be connected to the canister and an axially outwardly projecting portion at an end thereof opposite to said first end for assisting in enabling use of the butt cap and canister as a striking weapon.

Preferably, the blade is axially offset with respect to said handle portion.

The knife/bayonet component preferably includes a transitional portion between the blade and the handle portion and the transitional portion includes a through hole therein axially aligned with the handle portion of said component so as to permit a rifle on which the component is mounted to shoot through the through hole.

In accordance with a further aspect of the invention, there is provided a knife/bayonet device useful as both a knife and a bayonet adapted to be mounted on a barrel portion of a rifle having a groove therein, the device comprising: an integral knife/bayonet component including a hollow handle portion and a blade, said handle portion being adapted to fit onto the barrel portion of the rifle and including a locking groove having an opening therein extending through the handle portion; a locking means received in said locking groove and including a detent portion adapted to extend through the opening in said locking groove to engage in the groove in the barrel portion of the rifle and thereby secure the knife/bayonet component to the rifle; and a butt cap adapted to be received in said handle portion and a storage canister adapted to be affixed to the butt cap.

As discussed above, the barrel portion of the rifle preferably comprises a muzzle brake affixed to the barrel of the rifle, and the groove in the barrel portion comprises a standard circumferential groove in the muzzle brake. The handle portion of said knife/bayonet component preferably includes a plurality of holes therein in alignment with exhaust holes in the muzzle brake.

The butt cap preferably includes a transverse hole therethrough. The transverse hole advantageously includes a turning tool socket at at least one end thereof for receiving a turning tool stored in the canister.

Further features and advantages of the present invention will be set forth in, or apparent from, the detailed description of preferred embodiments thereof which follows.

DESCRIPTION OF THE PREFERRED EMBODIMENTS

Figure 1:
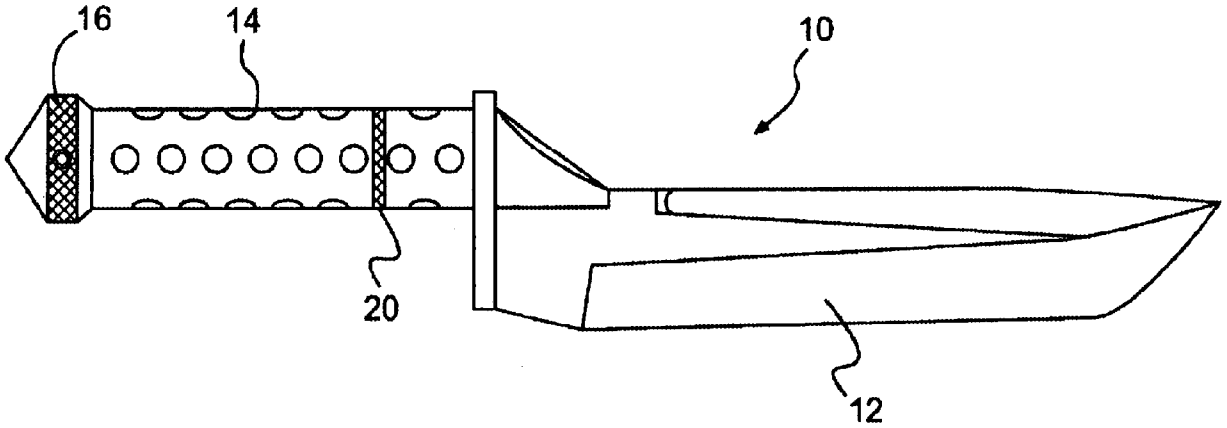
FIG. 1 is a side elevational view of a knife/bayonet device in accordance with a preferred embodiment of the invention, showing use of the fully assembled device as a knife.
Figure 6:
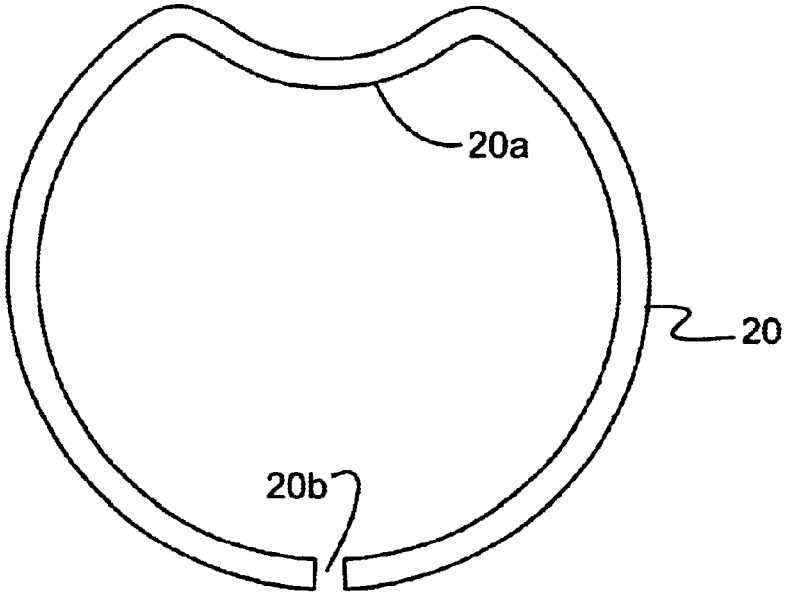
FIG. 6 is a front elevational view of the locking ring of FIG. 1.
Figure 7:
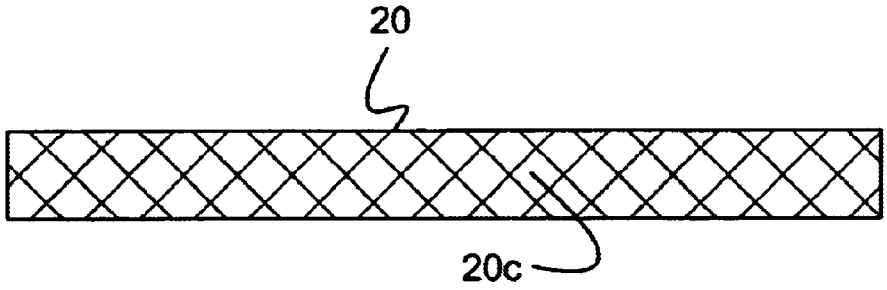
FIG. 7 is a side elevational view of the locking view of FIG. 6.

As indicated above, the device of the invention is useful both as a knife and a bayonet and, referring to FIG. 1, the device, which is generally denoted 10, is shown, fully assembled, for use as a knife. The device 10 includes knife/bayonet component or unit 11 comprising a blade 12 and a hollow handle portion or hilt 14. A butt cap 16 and associated canister 18 (not shown in FIG. 1), which are described below in connection with FIGS. 2 to 5, are received in hilt 14 while a locking ring 20, which is described below in connection with FIGS. 6 and 7, is received in a circumferential recess in hilt 14. The basic knife-bayonet construction or component is described below in connection with FIGS. 8 to 11. As indicated above, the offsetting of handle 14 and blade 12 provides advantages in the use of device 10 as a knife in close combat.

Figure 3:
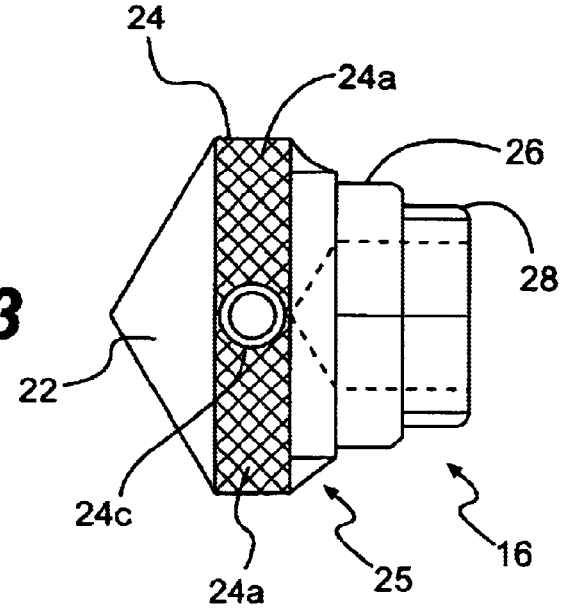
FIG. 3 is a side elevational view of the butt cap of FIG. 2.
Figure 4:
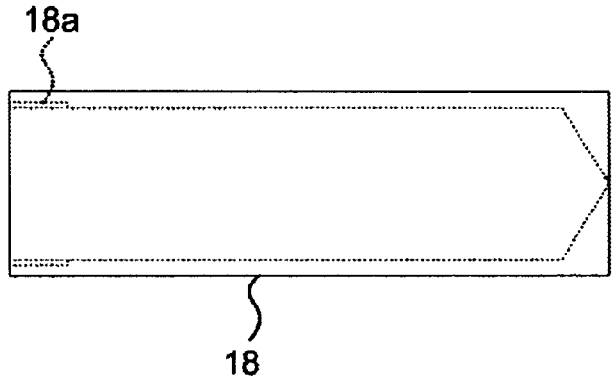
FIG. 4 is a side elevational view of the canister of FIG. 2.
Figure 5:
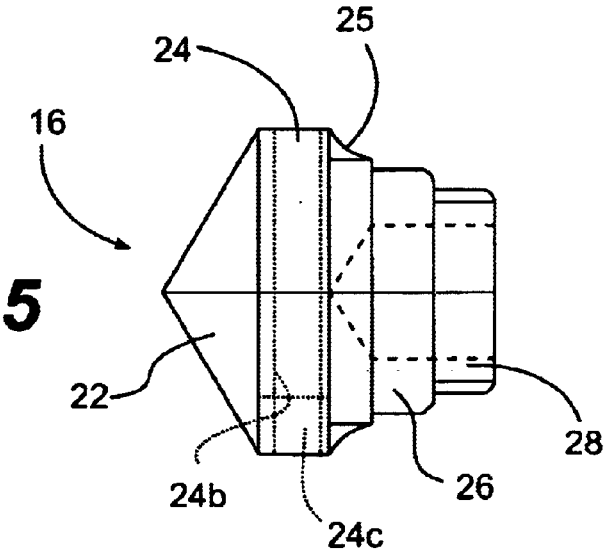
FIG. 5 is a top plan view of the butt cap of FIG. 2, with the knurling omitted.

Turning first to the butt cap 16 and canister 18, the former includes a generally pyramidal shaped end portion 22, an intermediate cylindrical portion 24 having a knurled outer surface 24*a* for improved gripping of butt cap 16, transitional portion 25 having radiussed profile as best seen in FIGS. 3 and 5, and two further cylindrical portions 26 and 28 which are of progressively decreasing diameter and include external screw threading indicated at 26*a* and 28*a*, respectively.

Figure 2:
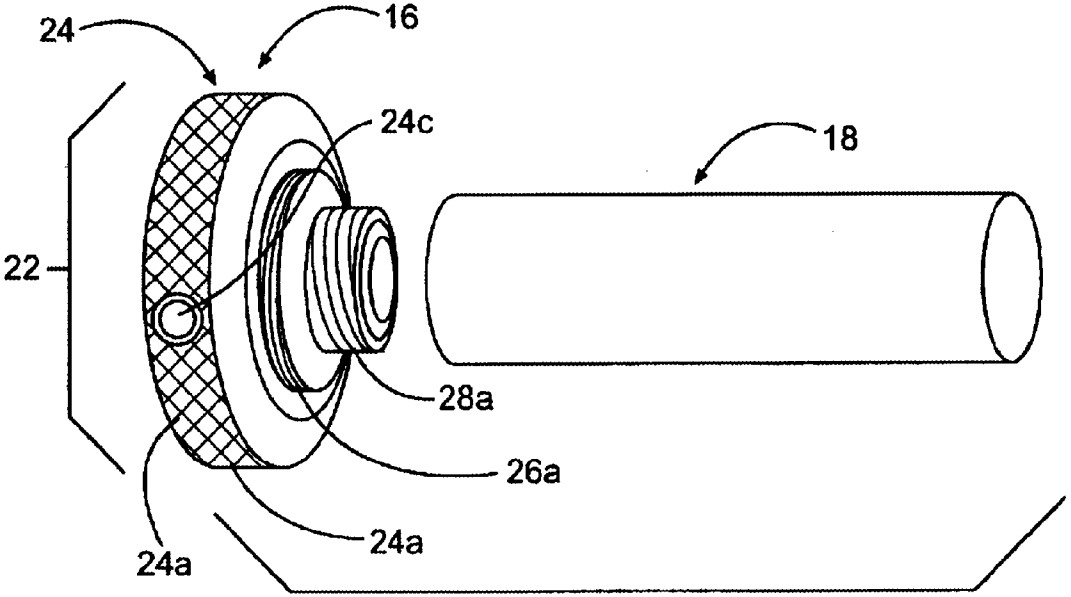
FIG. 2 is an exploded perspective view of the butt cap and canister of the device of FIG. 1.

A transverse opening or hole 24*b*, best seen in FIG. 5, extends through knurled portion 24 of butt cap 16, and one end of opening 24*b* includes a hexagonal (hex) portion 24*c* (see FIG. 3 and also FIG. 2). Hole 24*b* serves as a combination lanyard hole and, in combination with hex portion 24*c*, a hex drive socket for driving a turning tool (not shown) such as a screwdriver, "torx" or the like, stored in canister 18. In other words, a lanyard or other flexible support element (not shown) can be inserted through hole or opening 24*b* while the hexagonally shaped end portion 24*c* can be used as a socket to receive the proximal end of a tool such as screwdriver, so that by gripping butt cap 16 and canister 18 as a handle, the tool can be put to its intended use. In an exemplary, non-limiting example, hole 24*b* is a 3/16" hole and hex portion 24*c* is a ¼" hex socket.

Screw threading 26*a* permits butt cap 18 to be screwed into corresponding screw threading at the proximal end of hilt or handle 14, while screw threading 28*a* (see FIG. 2) permits butt cap 16 to be screwed into corresponding threading 18*a* of canister 18 (see FIG. 4) so as to provide watertight storage of items within canister 18. As indicated above, these items can include turning tools, as well as typical survival items such as first aid items, matches and the like. It is also noted that, when fully assembled, i.e., with the canister 18 screwed onto butt cap 16, the unit itself can be used as a striking weapon in close hand-to-hand combat.

Referring to FIGS. 6 and 7, and particularly to FIG. 6, locking ring 20 is of a generally circular configuration with an offset or indented portion 20*a* located directly opposite to a gap 20*b* between the ends of ring 20. As shown in FIG. 7, the outer surface 20*c* of ring 20 is knurled to enable better gripping. The function of ring 20 is to lock hilt 14 onto the muzzle brake of an automatic rifle such as the M16 or M4A1, as is described in more detail below and indented portion 20*a* serves as detent or retaining element in locking the knife/bayonet component 11 in a place on such a rifle.

Figure 10:
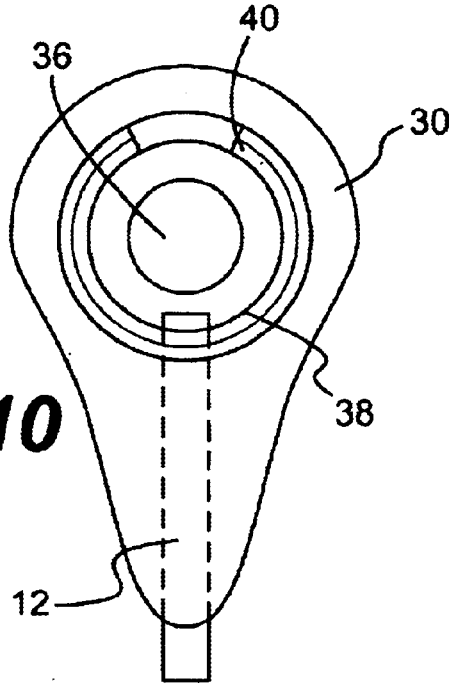
FIG. 10 is a transverse cross sectional view taken generally along lines A—A of FIG. 11.
Figure 9:
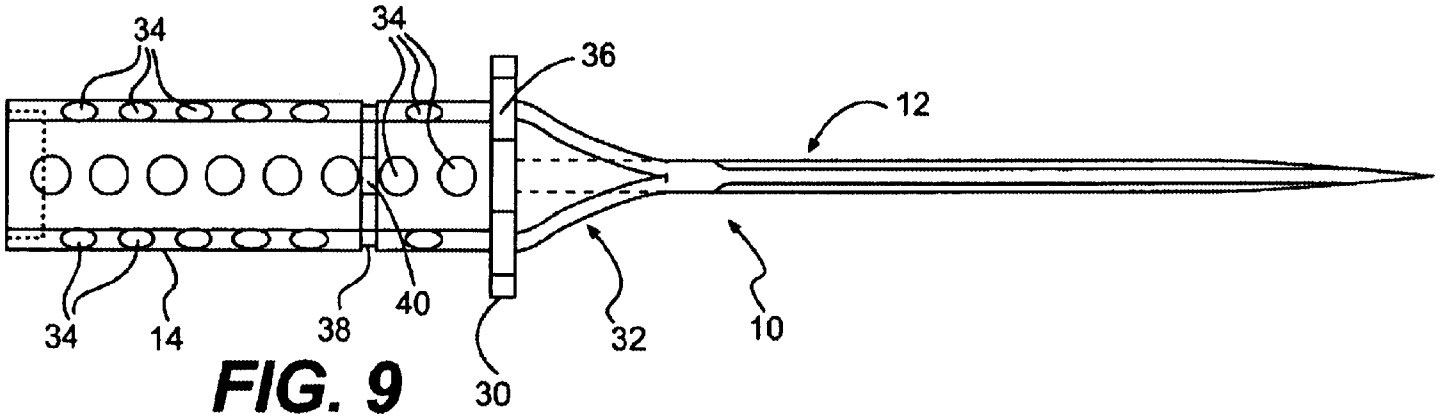
FIG. 9 is a top plan view of the knife/bayonet component of FIG. 9.
Figure 11:
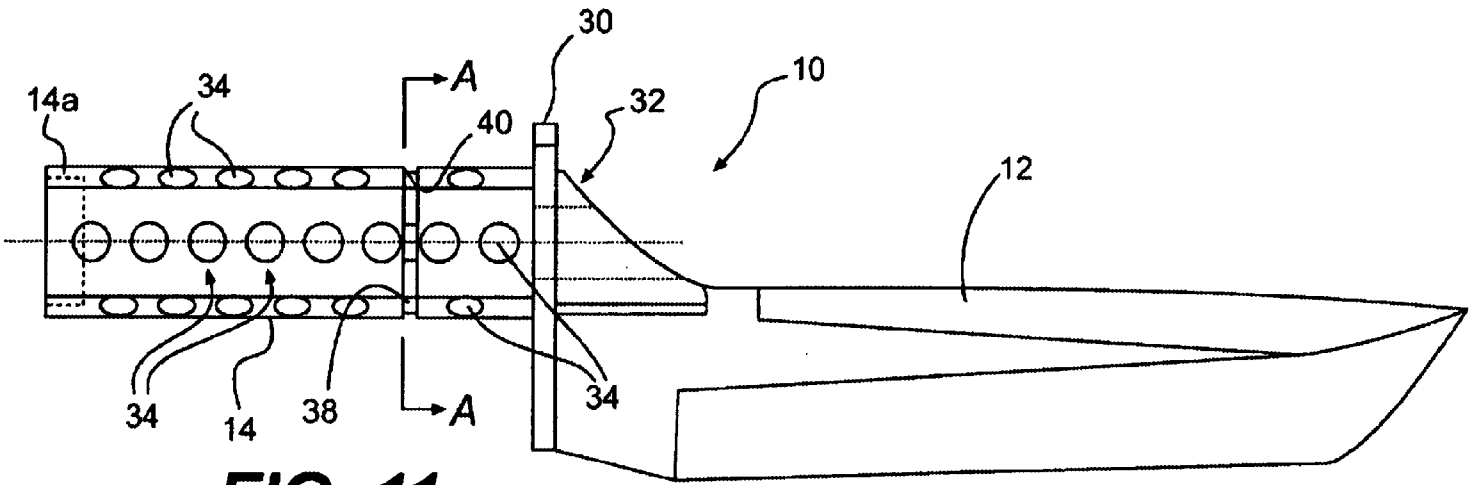
FIG. 11 is a side elevational view of the knife-bayonet component of FIG. 8.

Referring to FIGS. 9 to 11, the basic knife/bayonet component 11 of device 10 will now be described. As shown in FIG. 11, blade 12 is offset from handle 14 and as shown in FIGS. 9 and 11, is joined to handle 14 at the crossguard 30 by a transitional portion 32 which is radiussed as shown in FIG. 11 to provide weight reduction and cleanup of the general shape.

Figure 12:
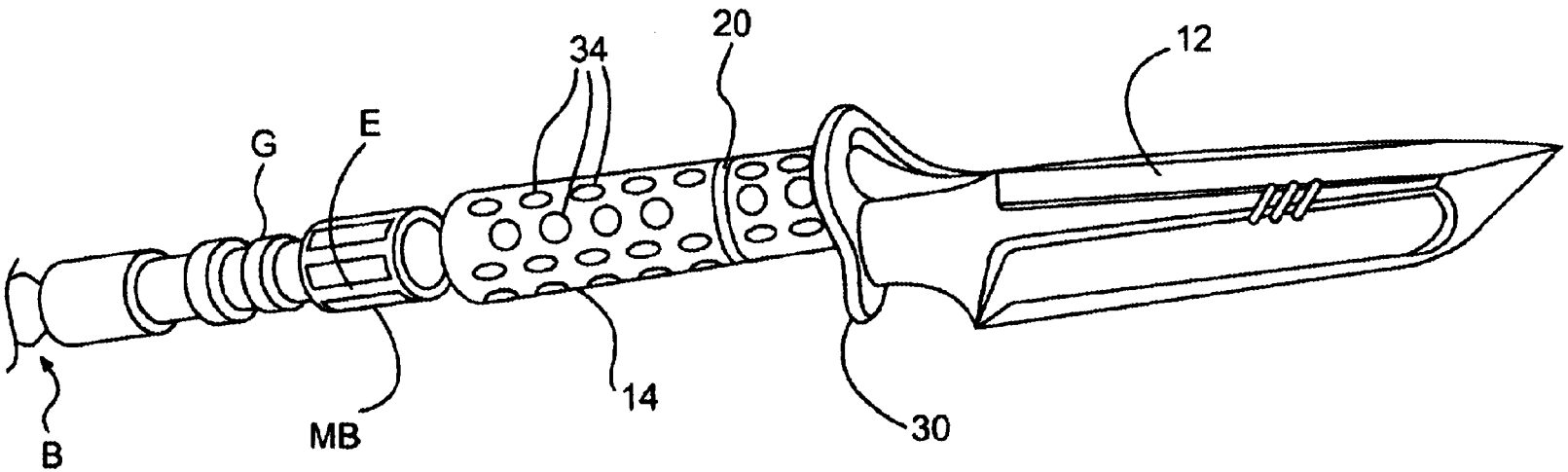
FIG. 12 is a perspective view of the device of FIG. 1, with the butt cap and canister removed, about to be fitted as a bayonet onto the muzzle brake of an automatic rifle.

Handle 14 includes holes 34 which reduce weight, combat heat buildup and improve the gripping surface presented. In a specific non-limiting example, holes 34 are 5/16" in diameter with ½" linear spacing and 45° radial spacing so that, referring to FIG. 12 which shows knife/bayonet component 11 about to be fit onto the muzzle brake MB of the barrel B of an automatic rifle, holes 34 so as to align with the exhaust holes E in the muzzle brake MB.

Figure 8:
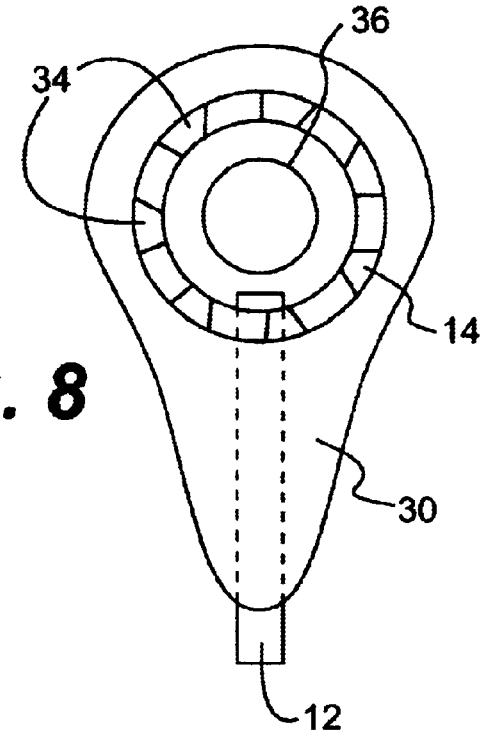
FIG. 8 is an end elevational view of the knife/bayonet component of the device of FIG. 1.

As shown in FIGS. 8 and 10, as well as FIGS. 9 and 11, crossguard 30 includes a central opening 36 that permits an automatic rifle to which unit 11 is attached to shoot through the opening 36, and thus, through the unit 11.

As shown in FIGS. 9 and 10, handle 14 includes screw threading 14*a* at the proximal end thereof which permits butt cap 16 to be screwed into handle 14.

Referring to FIGS. 9, 10 and 11, handle 14 further includes a circumferential locking groove or groove portion 38 located at intermediate position therealong closer to crossguard 30 than to the proximal end thereof, as illustrated. As perhaps can best be seen in FIGS. 9 and 10, groove portion 38 includes an opening 40 therein at the top thereof. In use, locking ring 20 is received in locking groove 38 and the indented or inwardly curved portion 20*a* of ring 20 projects through opening 40 so that locking ring 20 is seated on handle 14.

Referring again to FIG. 12, to affix knife/bayonet component 11 to an automatic rifle, butt cap 16 and canister 18 are removed and as knife/bayonet component 11 is pushed onto barrel B, the end of barrel B will cause the inwardly projecting portion 20*a* of locking ring 20 to become unseated. When the end of the barrel B contacts the shoulder formed by crossguard 30, the lock ring 20 snaps into a groove G in the muzzle brake MB thereby securing the knife/bayonet unit 11 in place on the automatic weapon.

In order to unlock and remove the knife/bayonet unit 11 from muzzle brake MB, the knurled surface 20*a* of the locking ring 20 is gripped by the fingers of a user and ring 20 is rotated approximately 30 degrees. This causes the inwardly curved portion 20*a* to ride out of, i.e., to be cammed out of, opening 40 so that portion 20*a* is no longer engaged in groove G, thereby permitting the knife/bayonet unit 11 to be removed.

It will be appreciated that the knife/bayonet unit 11 can be readily attached to, and removed from, muzzle brake MB, and in this regard, under test conditions, the unit 11 has been attached and locked onto a muzzle brake of an M16 or an M4A1 (corresponding to the muzzle brake indicated as MB in FIG. 12) in approximately four (4) seconds, in total darkness and without tools. Moreover, the unit 11 can be removed and re-sheathed in less than 10 seconds. In addition, a bayonet stud is not required.

Although the device of the invention has been described above in connection with the use thereof with an M16 or M4A1, it will be appreciated that the basic device and attachment scheme can be used with other guns as well.

More generally, although the invention has been described above in relation to preferred embodiments thereof, it will be understood by those skilled in the art that variations and modifications can be effected in these preferred embodiments without departing from the scope and spirit of the invention.

What is claimed:

1. A knife/bayonet device useful as both a knife and a bayonet adapted to be mounted on a muzzle brake affixed to a barrel of a rifle and having a standard circumferential groove therein, said device comprising:

an integral knife/bayonet component including a hollow handle portion and a blade having at least one longitudinally extending knife edge, said handle portion being adapted to fit onto the muzzle brake of the rifle and including a locking groove having an opening therein extending through the handle portion; and a locking ring received in said locking groove so as to be rotatable in said locking groove, said locking ring including a detent portion adapted to extend through said opening and engage in the standard groove in the muzzle brake of the rifle and thereby secure the knife/bayonet component to the rifle, said locking ring being rotatable between a first, locking position wherein said detent portion of the locking ring is seated in said opening and engages the standard groove in the muzzle brake, and a second, release position wherein the detent portion of the locking ring is unseated from said opening so as to disengage the detent portion from the standard groove and thus enable removal of said knife/bayonet component.

2. A knife/bayonet device as claimed in claim 1 wherein said handle portion of said knife/bayonet component includes a plurality of holes therein.

3. A knife/bayonet device as claimed in claim 2 wherein, in use, at least some of said holes in said handle are aligned with exhaust holes in the muzzle brake.

4. A knife/bayonet device as claimed in claim 1 wherein said locking ring includes a knurled outer surface.

5. A knife/bayonet device as claimed in claim 1 wherein said blade is axially offset with respect to said handle portion.

6. A knife/bayonet device as claimed in claim 1 wherein said knife/bayonet component includes a transitional portion between said blade and said handle portion and said transitional portion includes a through hole therein axially aligned with said handle portion of said component so as to permit a rifle on which the component is mounted to shoot through said through hole.

7. A knife/bayonet device useful as both a knife and a bayonet adapted to be mounted on a barrel portion of a rifle having a groove therein, said device comprising:

an integral knife/bayonet component including a hollow handle portion and a blade, said handle portion being adapted to fit onto the barrel portion of the rifle and including a locking groove having an opening therein extending through the handle portion;

a locking means received in said locking groove and including a detent portion adapted to extend through said opening in said locking groove to engage in the groove in the barrel portion of the rifle and thereby secure the knife/bayonet component to the rifle; and a butt cap adapted to be received in one end of said handle portion and a storage canister adapted to be affixed to said butt cap.

8. A knife/bayonet device as claimed in claim 7 wherein the barrel portion of the rifle comprises a muzzle brake affixed to the barrel of the rifle, and the groove in said barrel portion comprises a standard circumferential groove in the muzzle brake, said detent portion of said locking means being adapted to engage in said standard circumferential groove.

9. A knife/bayonet device as claimed in claim 8 wherein the muzzle brake includes exhaust holes, and said handle portion of said knife/bayonet component includes a plurality of holes therein in alignment with the exhaust holes in the muzzle brake.

10. A knife/bayonet device as claimed in claim 7 wherein said butt cap includes a transverse hole therethrough.

11. A knife/bayonet device as claimed in claim 10 wherein said transverse hole includes a turning tool socket at at least one end thereof for receiving a turning tool stored in said canister.

12. A knife/bayonet device useful as both a knife and a bayonet adapted to be mounted on a barrel portion of a rifle having a groove therein, said device comprising:

an integral knife/bayonet component including a hollow handle portion and a blade, said handle portion being adapted to fit onto the barrel portion of the rifle and including a locking groove having an opening therein extending through the handle portion; and a locking ring received in said locking groove so as to be rotatable in said locking groove, said locking ring including a detent portion adapted to extend through said opening and engage in the groove in the barrel portion of the rifle and thereby secure the knife/bayonet component to the rifle, said locking ring being rotatable between a first, locking position wherein said detent portion of the locking ring is seated in said opening and engages the groove in the barrel portion, and a second, release position wherein the detent portion of the locking ring is unseated from said opening so as to disengage the detent portion from the groove in the barrel portion and thus enable removal of said knife/bayonet component, said locking ring including a gap therein permitting opening of said ring to enable fitting thereof in said locking groove of said handle portion of said device.

13. A knife/bayonet device useful as both a knife and a bayonet adapted to be mounted on a barrel portion of a rifle having a groove therein, said device comprising:

an integral knife/bayonet component including a hollow handle portion and a blade, said handle portion being adapted to fit onto the barrel portion of the rifle and including a locking groove having an opening therein extending through the handle portion; and a locking ring received in said locking groove so as to be rotatable in said locking groove, said locking ring including a detent portion adapted to extend through said opening and engage in the groove in the barrel portion of the rifle and thereby secure the knife/bayonet component to the rifle, said locking ring being rotatable between a first, locking position wherein said detent portion of the locking ring is seated in said opening and engages the groove in the barrel portion, and a second, release position wherein the detent portion of the locking ring is unseated from said opening so as to disengage the detent portion from the groove in the barrel portion and thus enable removal of said knife/bayonet component, said handle portion having a proximal end, and said device further comprises a butt cap adapted to be received in the proximal end of said handle portion.

14. A knife/bayonet device as claimed in claim 13 further comprising a canister adapted to be connected to said butt cap.

15. A knife/bayonet device as claimed in claim 14 wherein said butt cap includes a transverse hole therethrough.

16. A knife/bayonet device as claimed in claim 15 wherein said transverse hole includes a turning tool socket at at least one end thereof for receiving a turning tool stored in said canister.

17. A knife/bayonet device as claimed in claim 16 wherein said butt cap includes a first threaded portion for enabling the butt cap to be screwed into the proximal end of said handle portion and a second threaded portion for enabling said butt cap to be screwed into said canister.

18. A knife/bayonet device as claimed in claim 15 wherein a portion of said butt cap including said through hole has a knurled outer surface.

19. A knife/bayonet device as claimed in claim 14 wherein said butt cap includes a first end adapted to be connected to said canister and an axially outwardly projecting portion at an end thereof opposite to said first end for assisting in enabling use of the butt cap and canister as a striking weapon.

* * * * *